US005583627A

United States Patent [19]

Sugiura

[11] Patent Number: 5,583,627

[45] Date of Patent: Dec. 10, 1996

[54] SHEET TRANSPORTING DEVICE IN AN IMAGE FORMING APPARATUS

[75] Inventor: Mitsushi Sugiura, Toyokawa, Japan

[73] Assignee: Minolta Co., Ltd., Osaka, Japan

[21] Appl. No.: 377,003

[22] Filed: Jan. 23, 1995

[30] Foreign Application Priority Data

Jan. 25, 1994 [JP] Japan ..... 6-006220

[51] Int. Cl.[6] ..... B65H 7/00; G03G 15/00

[52] U.S. Cl. ..... 355/308; 271/8.1; 271/278; 355/200

[58] Field of Search ..... 355/308, 309, 355/200, 207; 271/8.1, 278

[56] References Cited

FOREIGN PATENT DOCUMENTS 4-354732 12/1992 Japan .

*Primary Examiner*—William J. Royer

*Assistant Examiner*—Sophia S. Chen

*Attorney, Agent, or Firm*—Burns, Doane, Swecker & Mathis, LLP

[57] ABSTRACT

An image forming apparatus having a sheet transporting path which is arranged by a pair of guide members openable each other. The image forming apparatus is separated into a first unit including a photosensitive member and a second unit by the sheet transporting path. A force exerting member is provided on either one of the guide members and exerts a force on a sheet present in the sheet transporting path to remain the sheet on the guide member which is disposed on the second unit side.

8 Claims, 5 Drawing Sheets

SHEET TRANSPORTING DEVICE IN AN IMAGE FORMING APPARATUS

BACKGROUND OF THE INVENTION

1. Field of the Invention

The present invention relates to an image forming apparatus for copiers, printers and the like, and more specifically relates to an image forming apparatus having a separable sheet transporting path.

2. Description of the Related Art

It has been proposed in the past, in electrophotographic image forming apparatus such as copiers, printers and the like, to separate the apparatus in top and bottom sections by a sheet transport path for maintenance around the photosensitive member and the like, as well as removal of sheets remaining within the apparatus due to paper jams and the like when problems occur in the apparatus when removing remaining sheets from the afore-mentioned image forming apparatus separated by a sheet transport path, the sheet is readily removed in comparison to apparatus which are not separated by a transport path because a hand can be inserted into said transport path as well as the sheet is also visually accessible.

In conventional image forming apparatus separated by a sheet transport path, sheets typically remain on the bottom side of the separated transport path. However, during transport, a sheet is electrostatically attracted to the top side, or conversely transport rollers and guides on the top side electrostatically attract the sheet. Thus, an operator must face the problem of searching both of the separated sides. Particularly when a plurality of sheets remain within the apparatus, a sheet may be removed from one side while a sheet in the other side is overlooked, such that after the top and bottom sections of the apparatus have been joined, they must again be separated in order to remove the previously overlooked remaining sheet.

Furthermore, when a sheet remaining in the apparatus is located in the vicinity of the photosensitive member, said sheet is attracted to said photosensitive member by means of the residual electric potential on the surface of said photosensitive member, such that when the apparatus is opened, said sheet is lifted upward together with the photosensitive member. In order to remove the aforesaid remaining sheet, an operator must place a hand near the photosensitive member, and may inadvertently cause damage to the photosensitive member when removing the remaining sheet.

SUMMARY OF THE INVENTION

A main object of the present invention is to provide an image forming apparatus which allows rapid paper jam removal processing.

A further object of the present invention is to provide an image forming apparatus which allows easy discovery of sheets remaining within said apparatus during paper jam processing.

A still further object of the present invention is to provide an image forming apparatus which allows removal of remaining sheets during jam processing without damage to the photosensitive member or components on the periphery thereof.

These and other objects of the invention are achieved by providing a sheet transporting device comprising a first guide member, a second guide member provided along said first guide member, said first and second guide members forming a sheet transporting path therebetween and being openable each other, sheet transporting rollers transporting a sheet in the sheet transporting path, and a force exerting member which is provided on said second guide member and exerts a force on a sheet present in the sheet transporting path to remain on said second guide member when said first and second guide members are opened.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DETAILED DESCRIPTION OF THE PREFERRED EMBODIMENTS

Figure 1:
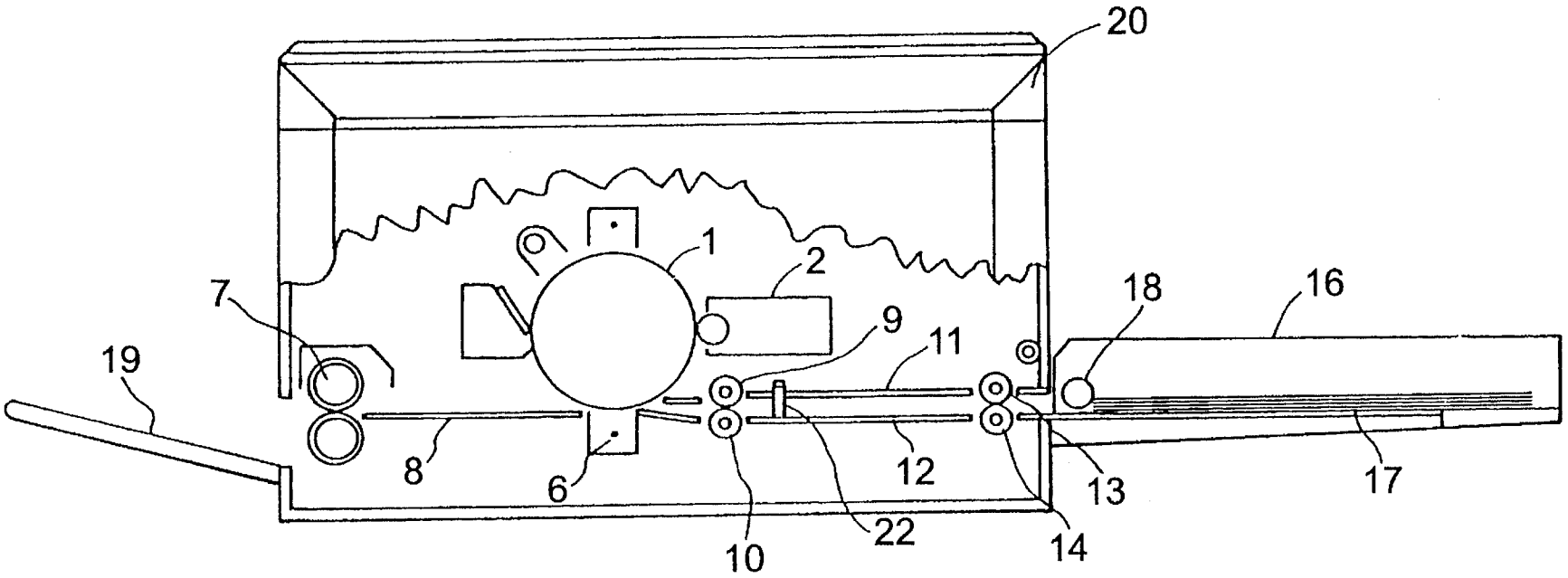
FIG. 1 is a partial section view of a coping apparatus using the force exerting means of the present invention.

The preferred embodiments of the present invention is described hereinafter with reference to the accompanying drawings. FIG. 1 is a partial section view of coping apparatus 20. An electrostatic latent image of an original document image projected by an optical unit not illustrated is formed on the surface of photosensitive member 1 in conjunction with the rotation of said photosensitive member 1, and is developed as a toner image via developing device 2. The obtained toner image is subsequently transferred onto sheet 17, i.e., a sheet-like transfer member, via transfer charger 6. Sheets 17 are stacked in sheet tray 16, and transported one sheet at a time into the copying apparatus by pick-up roller 18. Sheet 17, which has been fed into copying apparatus body 20, is transported from transport rollers 13 and 14, through transport guides 11 and 12, to registration rollers 9 and 10. Sheet separation projection guide 22, i.e., force exerting means, is provided on bottom transport guide 12. Sheet 17 is temporarily stopped at registration rollers 9 and 10, and thereafter transported with a timing such that the leading edge of said sheet 17 and the leading edge portion of a toner image formed on the surface of photosensitive member 1 arrive at the transfer section simultaneously. Sheet 17, which now carries the transferred toner image, is fed past transport guide 8 to fixing device 7 where the unfixed toner image is fused on the surface of sheet 17, and thereafter said sheet 17 is discharged to discharge tray 19 provided outside the copying apparatus.

The aforesaid consecutive process continues, and sheet 17 is discharged from the copying apparatus. However, occasions may arise wherein sheet(s) stop within the copying apparatus due to trouble in the sheet transport system. On such occasions, the sheet remaining in the copying apparatus must be removed.

Figure 2:
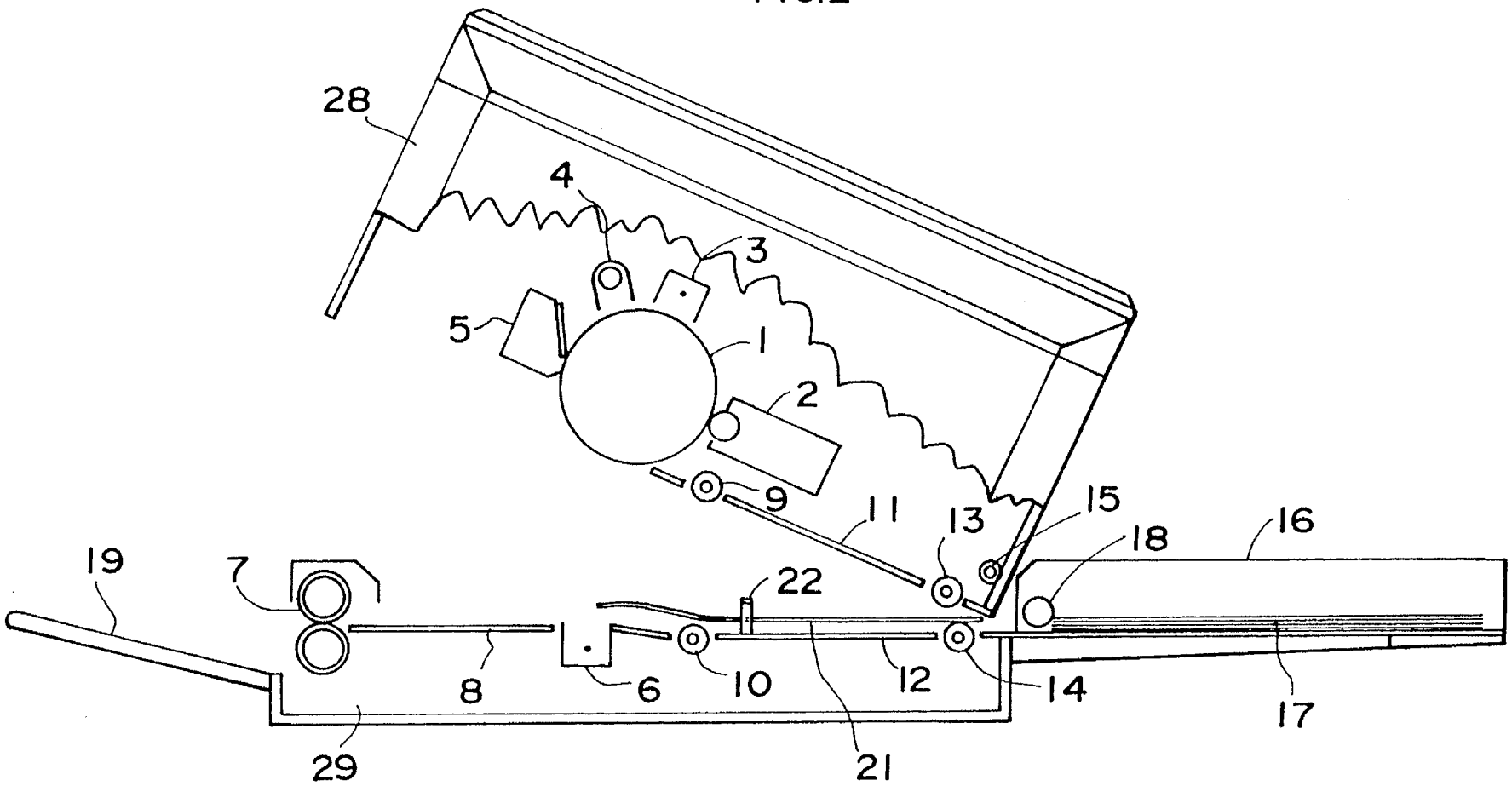
FIG. 2 is an illustration showing the copying apparatus of FIG. 1 when a first unit and a second unit are separated by a sheet transport path.

FIG. 2 shows a copying apparatus wherein top unit 28 corresponds to a first unit, and bottom unit 29 corresponds to a second unit, and said units are in an open state. The aforesaid is a copying apparatus of a so-called clamshell type. Though various types of the opening plane for opening the top and bottom of the apparatus is considerable, the aforesaid is a type which opens on the border of the transport guide plane.

Figure 3:
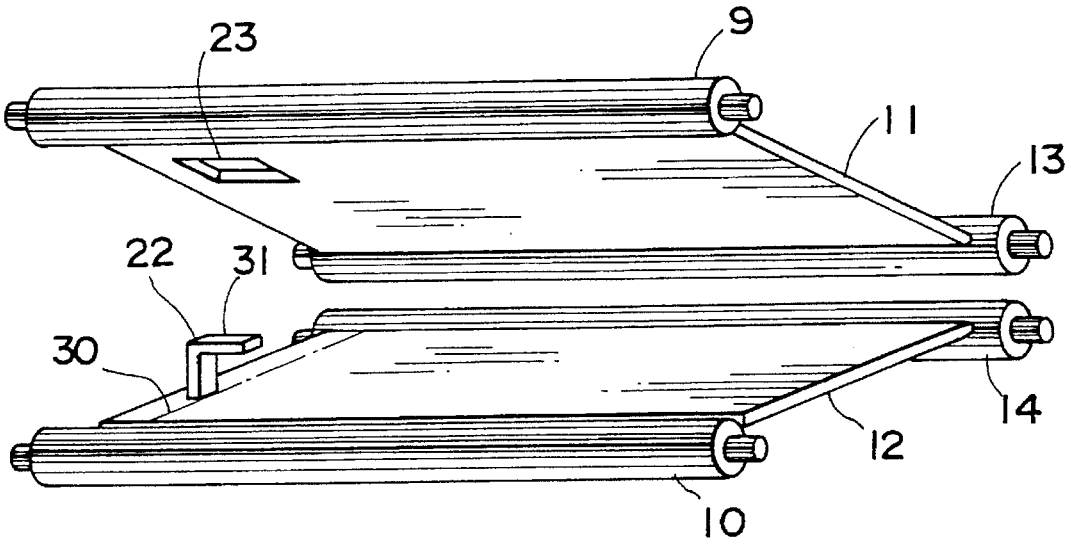
FIG. 3 is an illustration showing the sheet transport sections of the copying apparatus of FIG. 2 as viewed from the left side of FIG. 2.

FIG. 3 shows the section with transport guides 11 and 12 shown in FIG. 2 viewed from a different angle. This copying apparatus is an example of a copier in which a single side of a sheet is regulated during the passage of the sheet called normal single-side alignment, that is, one side of a sheet always passes sheet regulating position 30 regardless of the size of the sheet. Sheet separation guide 22, i.e., force exerting means, is provided on the bottom transport guide 12 and protrudes to the top transport guide 11 side on the outer side of sheet regulating position 30. The leading edge portion of sheet separation guide 22 is curved toward transport side so as to overlap the sheet regulating position 30, and forms a hook portion 31 which makes contact with sheet 17 when the first and second units are separated. Clearance hole 23 is provided on top transport guide 11 which allows sheet separation guide 22 to extend therethrough such that sheet separation guide 22 does not prevent sheet passage, and top transport guide 11 and bottom transport guide 12 are adjacent to one another. It is desirable that sheet separation guide 22 is provided in the vicinity of registration rollers 9 and 10 adjacent to photosensitive member 1 so as to prevent damage to said photosensitive member 1 when removing a remaining sheet which has adhered to the surface of said photosensitive member 1.

In copying apparatus having the previously described construction, when the leading edge of a sheet remains stopped between the registration rollers 9 and 10 beneath photosensitive member 1, the copying apparatus body 20 is bisected, and a remaining sheet 21 tends to adhere to either photosensitive member 1, or top registration roller 9, or top transport guide 11, so as to be moved together with top unit 28 of the copying apparatus. However, said remaining sheet 21 is pushed downward by hook portion 31 of sheet separation guide 22 so as to remain on the bottom transport guide 12, i.e., bottom unit 29.

Figure 5:
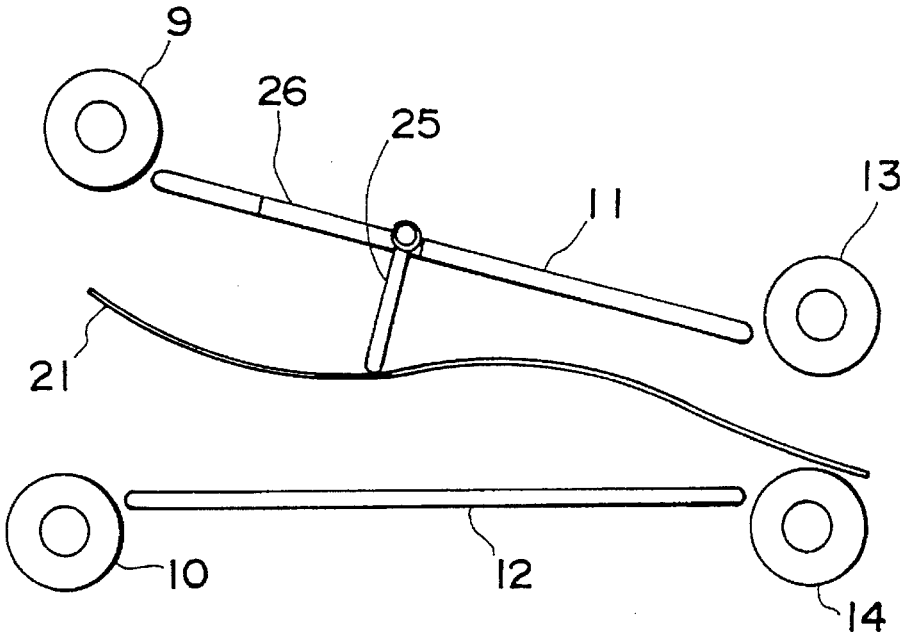
FIG. 5 is an illustration showing the first and second units of FIG. 4 in the separated state.
Figure 6:
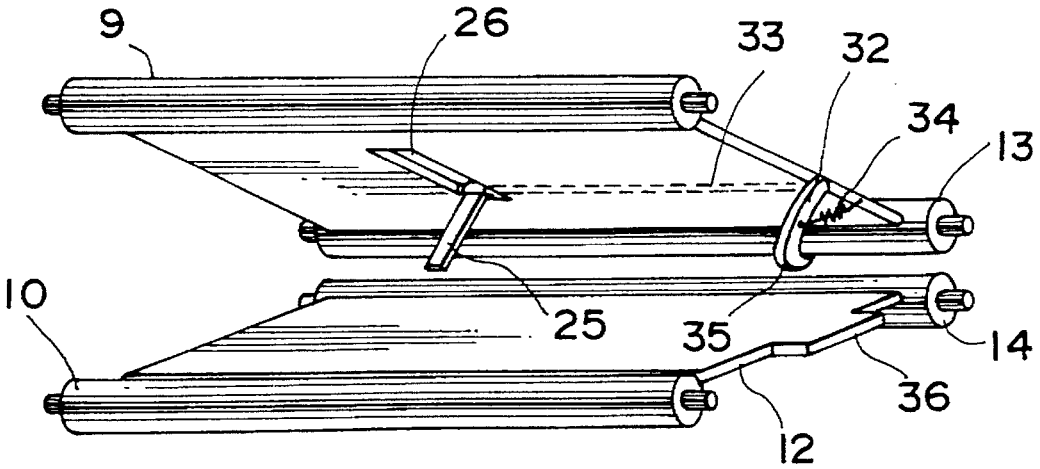
FIG. 6 is an illustration showing a second embodiment of the sheet transport section viewed from the left side of FIG. 4.

A second embodiment of the present invention is described hereinafter with reference to FIGS. 4, 5, and 6. In the second embodiment, sheet separation lever 25 is provided on the top transport guide 11 side. One end of sheet separation lever 25 is fixedly mounted to shaft 33, so as to be oscillatable in conjunction with the rotation of said shaft 33. Shaft 33 is supported so as to be freely rotatable extending in a perpendicular direction relative to the sheet transport direction on a side of the transport surface of top transport guide 11, and is further connected to positioning lever 32 disposed on the outside of the transport path. Sheet separation lever 25 and positioning lever 32 are connected by shaft 33, so as to form an integrated unit. Sheet separation lever 25 pivots on a rotation point (shaft 33), and is integratedly formed with positioning lever 32 and shaft 33 so as to be freely rotatable. Positioning lever 32 is connected to top transport guide 11 by spring 34, and leading edge 35 exerts a force in the direction of bottom transport guide 12. Clearance hole 26 is provided on top transport guide 11, such that sheet separation lever does not prevent sheet passage.

Figure 4:
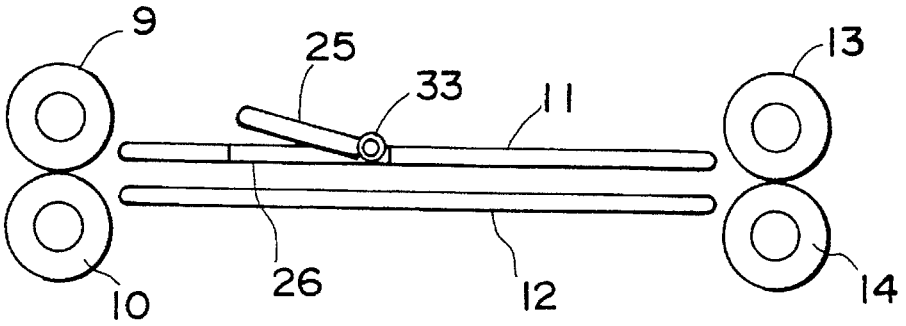
FIG. 4 is a section view showing the normal state of a second embodiment of the force exerting means of the present invention in a sheet transport path when the first and second units are closed.

In a normal sheet transport operation, leading edge 35 of positioning lever 32 connected to sheet separation lever 25 via shaft 33 makes contact with base 36 protruding from bottom transport guide 12, such that said sheet separation lever 25 is lifted behind top transport guide 1, as shown in FIG. 4. When the top and bottom units of copying apparatus 20 are separated, the leading edge 35 of positioning lever 32 is released from contact with base 36, and sheet separation lever 25 protrudes to the transport path side via the force exerted by spring 34. When a sheet 21 remains inside the transport path, said sheet 21 is caused to fall by sheet separation lever 25 even when said sheet adheres to top unit 28, such that said sheet 21 invariably remains on the bottom unit 29. Conversely, when the separated top and bottom units are closed by closing top unit 28, leading edge 35 of positioning lever 32 makes contact with base 36 and rotates against the force of spring 34, sheet separation lever 25 passes through clearance hole 26 of transport guide 11, and is turned out to the after side thereof so as to be integrated with copying apparatus 20. When construction is such as described in the second embodiment, the sheet passage method is not limited to single-side passage regulation, inasmuch as it may be adapted to apparatus using a center passage regulation method, and sheets reliably remain on the top of the bottom unit when top unit 28 and bottom unit 29 are separated.

A method is considerable wherein sheet separation lever 25 is mounted on top transport guide 11 so as to be freely rotatable via a shaft as a simplification of the method of the second embodiment. In this instance, when the top and bottom units are separated, sheet separation lever 25 drops downward to the transport path side via its own weight, and even a sheet adhered to the top unit falls onto the top of the bottom unit, as shown in FIG. 5. When a sheet is transported in a normal copy operation, sheet 21 is forcibly fed by transport rollers 13 and 14, and pushes sheet separation lever 25 upward so as to arrive at registration rollers 9 and 10. In this construction, the reliability of the sheet dropping on the bottom unit is slightly less compared to that of the second embodiment, however, this method has the advantage of an extremely simple construction, a definite asset from the perspectives of cost and production. Although only a single sheet separation lever is shown in the second embodiment and the aforesaid modification thereof, a plurality of such levers may be provided. Greater reliability in disposing a sheet on the bottom unit can be achieved by providing a plurality of sheet separation lever.

Figure 7:
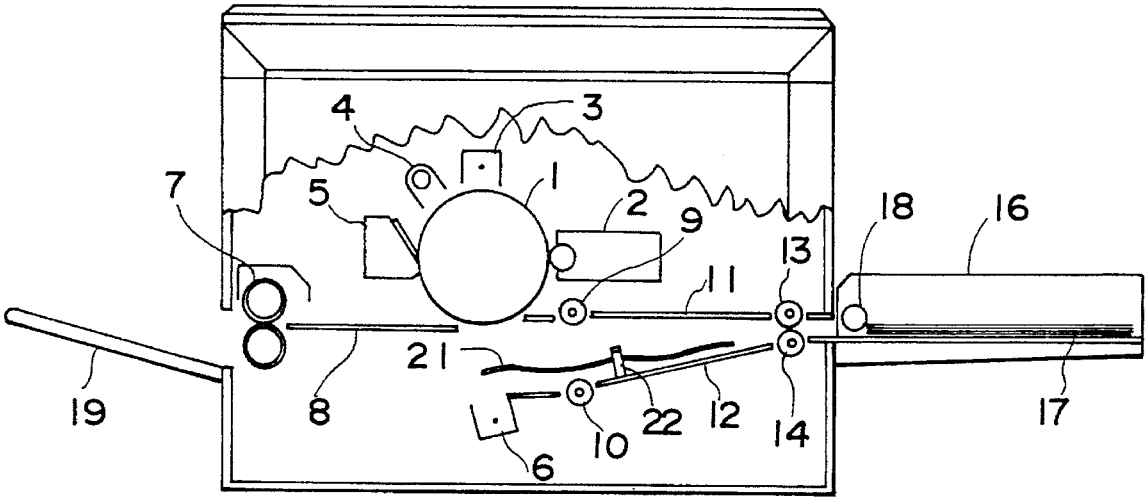
FIG. 7 shows another embodiment of the sheet transport path in the open state.

Although the present invention has been described in terms of copying apparatus of a clamshell type which is separable into top and bottom units by raising the top unit upward, it is to be understood that the invention is applicable to separable constructions wherein the bottom unit is turned out. As shown in FIG. 7, the apparatus body is not divided into units, and only the guide section is divided at the border of the transport guide surface. FIG. 7 shows an apparatus capable turning out the bottom side guide section in a downward direction, although the invention is applicable to apparatus using other modalities.

The present invention is further applicable not only to apparatus wherein the transport path opens vertically, but also to transport paths in perpendicular directions, if the transport path is openable in a direction of the normal line of the transfer sheet surface.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A sheet transporting device comprising:

a first guide member;

a second guide member provided along said first guide member, said first and second guide members forming a sheet transporting path therebetween and being openable to each other;

sheet transporting rollers transporting a sheet in the sheet transporting path; and a force exerting member which is provided on said first guide member and exerts a force on a sheet present in the sheet transporting path to remain on said second guide member when said first and second guide members are opened.

2. The sheet transporting device as claimed in claim 1, wherein said force exerting member is pivotally attached to said first guide member by its one end to protrude to the sheet transporting path when said first and second guide members are opened.

3. The sheet transporting device as claimed in claim 2, wherein said one end is connected with a spring member which exerts a force to said force exerting member so as to pivot toward the sheet transporting path in conjunction with opening of said first and second guide members.

4. The sheet transporting device as claimed in claim 2, wherein said first and second guide members are arranged horizontally and said force exerting member protrudes to the sheet transport path by own weight when said first and second guide members are opened.

5. A image forming apparatus comprising:

a first unit having a photosensitive member therein and a first guide surface;

a second unit having a second guide surface along said first guide surface, said first and second guide surface forming a sheet transporting path therebetween;

connecting means for separably connecting said first and second units;

sheet transporting rollers transporting a recording sheet in the sheet transporting path; and a force exerting member provided on said first unit and exerting a force on a sheet present in the sheet transport path to remain the sheet on said second guide surface when said first and second units are separated.

6. The image forming apparatus as claimed in claim 5, wherein said force exerting member is pivotally attached to said first guide surface by its one end.

7. The image forming apparatus as claimed in claim 5 further comprising a spring member at a side edge of said first guide surface, said spring member is connected with said force exerting member so as to make the force exerting member protrude into the sheet transporting path in conjunction with separation of said first and second guide surfaces.

8. The image forming apparatus as claimed in claim 6, wherein said first and second guide surfaces are arranged horizontally with said first unit being positioned upper side of said sheet transport path, and said force exerting member protrudes to the sheet transport path by own weight when the first and second units are separated.

* * * * *